US005457619A

United States Patent [19]

Ewing

[11] Patent Number: 5,457,619

[45] Date of Patent: Oct. 10, 1995

[54] MAGNETIC LIGHT

[76] Inventor: Brian D. Ewing, Rte. 3 Box 285, Stockton, Mo. 65785

[21] Appl. No.: 239,907

[22] Filed: May 9, 1994

[51] Int. Cl.[6] ..... F21V 21/08

[52] U.S. Cl. ..... 362/398; 362/376

[58] Field of Search ..... 362/369, 398, 362/399, 400

[56] References Cited

U.S. PATENT DOCUMENTS

| | | | |
|---|---|---|---|
| 1,344,206 | 6/1920 | Koenig | 362/398 |
| 2,458,138 | 1/1949 | Blanchard, Jr. | 362/398 |
| 4,321,660 | 3/1982 | Sokol | 362/398 |
| 4,564,894 | 1/1986 | Gonzalez | 362/398 |
| 4,672,515 | 6/1987 | Baker | 362/398 |
| 4,727,462 | 2/1988 | Komonko | 362/398 |

FOREIGN PATENT DOCUMENTS

| | | | |
|---|---|---|---|
| 148712 | 8/1920 | United Kingdom | 362/398 |

*Primary Examiner*—Ira S. Lazarus
*Assistant Examiner*—L. Heyman

[57] ABSTRACT

A trouble light is provided with a metal protective cage which surrounds a light bulb and has planar surfaces. When energized by a separate switch, an electromagnet within the handle generates a magnetic field which magnetizes the protective cage, enabling it to be mounted to any convenient ferrous metal surface, such as the hood of a car.

4 Claims, 3 Drawing Sheets

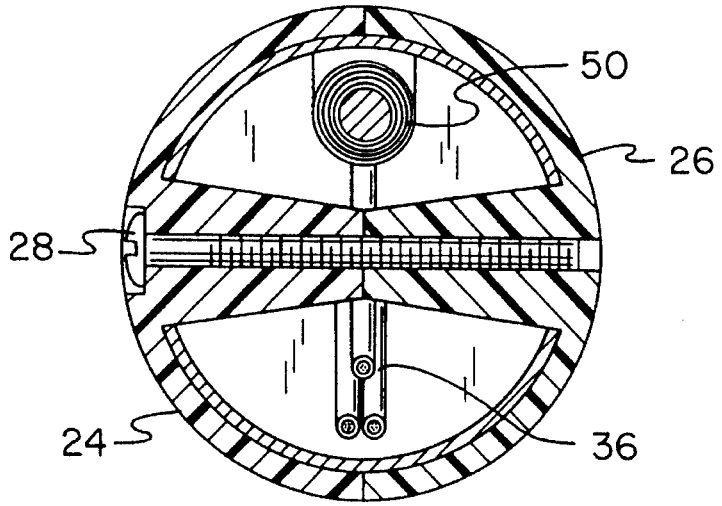
FIG. 3
FIG. 4
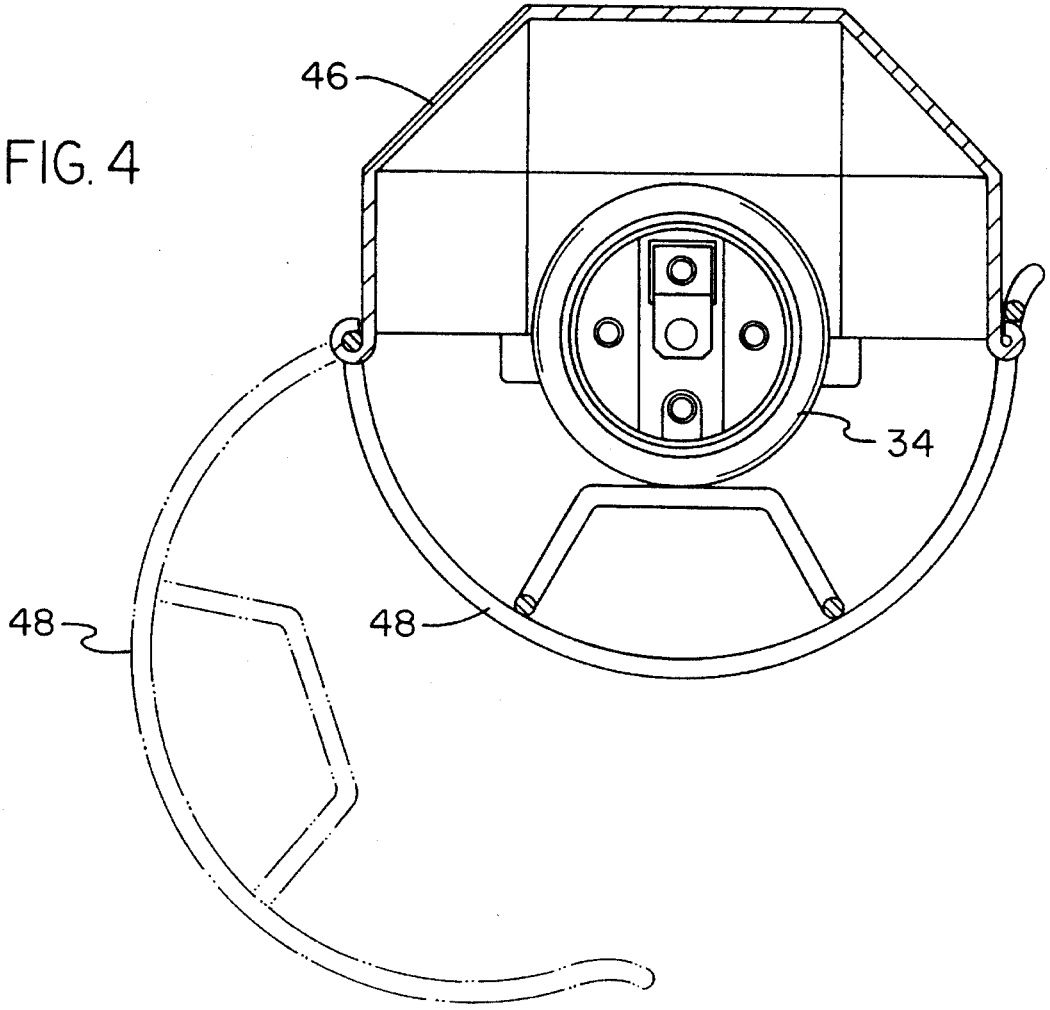

MAGNETIC LIGHT

BACKGROUND OF THE INVENTION

1. Field of the Invention

The present invention relates to a magnetic light and more particularly pertains to magnetically mounting a drop light to a metallic surface on the hood of an automobile with an on/off option with a magnetic light.

2. Description of the Prior Art

The use of drop lights is known in the prior art. More specifically, drop lights heretofore devised and utilized for the purpose of lighting to see the engine of an automobile are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,213,412 to Ciallella discloses a drop light with magnet and hook.

U.S. Pat. No. Des. 322,328 to Burgett discloses the design of a multi-position drop light.

U.S. Pat. No. 4,727,462 to Komonko discloses a clamp-on magnet for trouble lights.

U.S. Pat. No. 4,470,106 to Norton discloses a shop light.

U.S. Pat. No. 3,809,883 to Goodwin discloses a universal trouble light support.

While these devices fulfill their respective, particular objective and requirements, the aforementioned patents do not describe a magnetic light that magnetically mounts a drop light to a metallic surface on the hood of an automobile with an on/off option.

In this respect, the magnetic light according to the present invention substantially departs from the conventional concepts and designs of the prior art, and in doing so provides an apparatus primarily developed for the purpose of magnetically mounting a drop light to a metallic surface on the hood of an automobile with an on/off option.

Therefore, it can be appreciated that there exists a continuing need for a new and improved magnetic light which can be used for magnetically mounting a drop light to a metallic surface on the hood of an automobile with an on/off option. In this regard, the present invention substantially fulfills this need.

SUMMARY OF THE INVENTION

In the view of the foregoing disadvantages inherent in the known types of drop lights now present in the prior art, the present invention provides an improved magnetic light. As such, the general purpose of the present invention, which will be described subsequently in greater detail, is to provide a new and improved magnetic light and method which has all the advantages of the prior art and none of the disadvantages.

To attain this, the present invention essentially comprises an oblong hollow handle having an first end, a second end, an intermediate extent therebetween, an inner surface, an outer surface, an upper portion, and a lower portion. The upper portion and lower portion are coupled by a fastening means. The oblong hollow handle is encompassed by an insulated plastic. A first switch is integral with the outer surface. A second switch is integral with the outer surface. An electrical socket is secured to the second end of the oblong hollow handle. The electrical socket functions to receive a light bulb. The electrical socket has a wire having a first end and a second end. The first end of the wire is electrically secured to one end of the electrical socket. The second end of the wire has an electrical plug thereattached. A push button switch is attached to the electrical socket thus allowing the light bulb to be in an on or off position. The push button switch corresponds with the first switch of the oblong hollow handle. The present invention contains a metal casing that includes a plurality of planar surfaces. The metal casing is secured to the second end of the oblong hollow handle. The metal casing has a generally flat surface. A metal cage is hingedly secured to the metal casing. The metal cage functions to prevent contact with a light bulb. An electromagnet is secured to the inner surface of the intermediate extent of the oblong hollow handle. The electromagnet has a first wire and a second wire. The first wire is electrically connected with the metal casing. The second wire is electrically connected with the second switch of the oblong hollow handle thus allowing the electromagnet to be turned on to generate a magnetic field on the metal casing or off to disengage the magnetic field.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic light which has all the advantages of the prior art drop lights and none of the disadvantages.

It is another object of the present invention to provide a new and improved magnetic light which may be easily and efficiently manufactured and marketed.

It is a further object of the present invention to provide a new and improved magnetic light which is of durable and reliable construction.

An even further object of the present invention is to provide a new and improved magnetic light which is susceptible of a low cost of manufacture with regard to both materials and labor, and which accordingly is then susceptible of low prices of sale to the consuming public, thereby making such a magnetic light economically available to the buying public.

Still yet another object of the present invention is to provide a new and improved magnetic light which provides in the apparatuses and methods of the prior art some of the advantages thereof, while simultaneously overcoming some of the disadvantages normally associated therewith.

Even still another object of the present invention is to provide a new and improved magnetic light for magnetically mounting a drop light to a metallic surface on the hood of an automobile with an on/off option.

Lastly, it is an object of the present invention to provide a new and improved magnetic light consisting of an oblong hollow handle having a first end, a second end, an intermediate extent therebetween, an inner surface, and an outer surface. The oblong hollow handle encompassed by an insulated plastic. An electrical socket is secured to the second end of the oblong hollow handle. The electrical socket functions to receive a light bulb. The electrical socket has a wire having a first end and a second end. The first end of the wire is electrically secured to one end of the electrical socket. The second end of the wire has an electrical plug thereattached. The present invention contains a metal casing including a plurality of planar surfaces. The metal casing is secured to the second end of the oblong hollow handle. The metal casing has a generally flat surface. A metal cage is hingedly secured to the metal casing. The metal cage functions to prevent contact with a light bulb. An electromagnet is secured to the inner surface of the intermediate extent of the oblong hollow handle. The electromagnet has a wire. The wire is electrically connected with the metal casing thus allowing the electromagnet to be turned on to generate a magnetic field on the metal casing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as seen along line 3—3 of FIG. 2.

FIG. 4 is a cross-sectional view of the metal cage as seen along line 4–4 of FIG. 2.

The same reference numerals refer to the same parts through the various Figures.

DESCRIPTION OF THE PREFERRED EMBODIMENT

Figure 1:
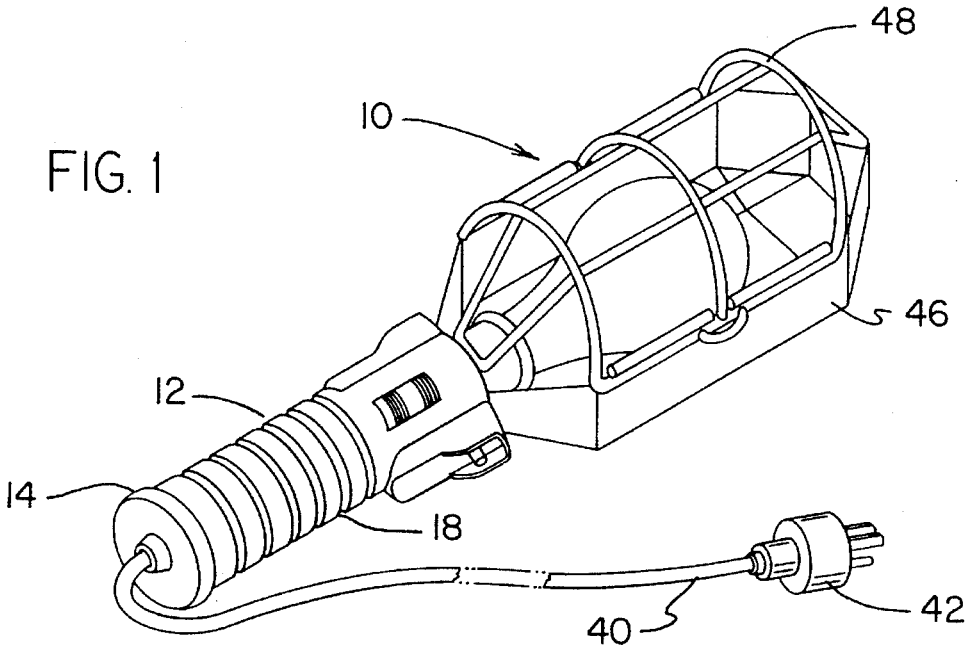
FIG. 1 is a perspective view of the preferred embodiment of the magnetic light constructed in accordance with the principles of the present invention.
Figure 2:
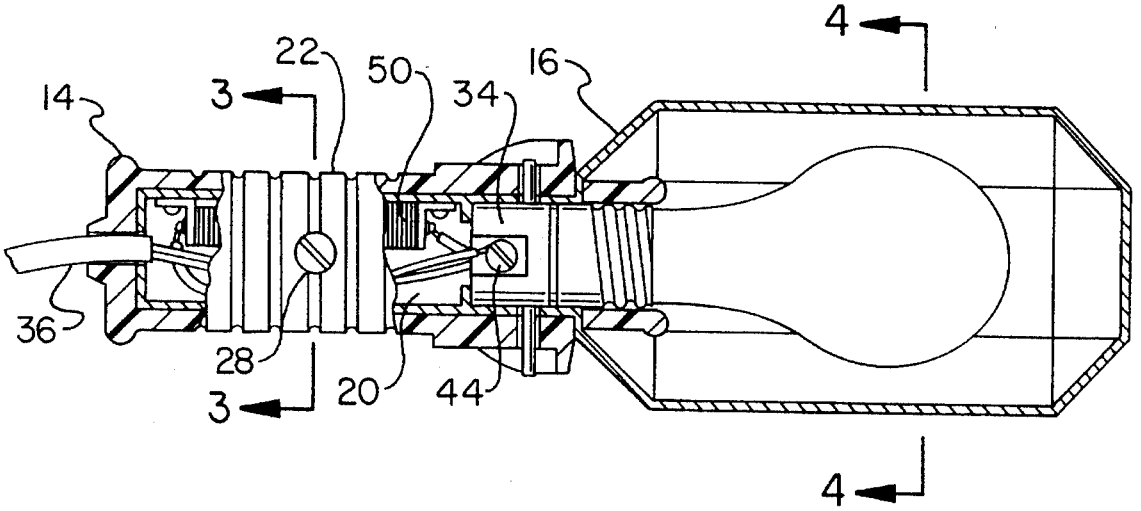
FIG. 2 is a top sectional view of the present invention.
Figure 5:
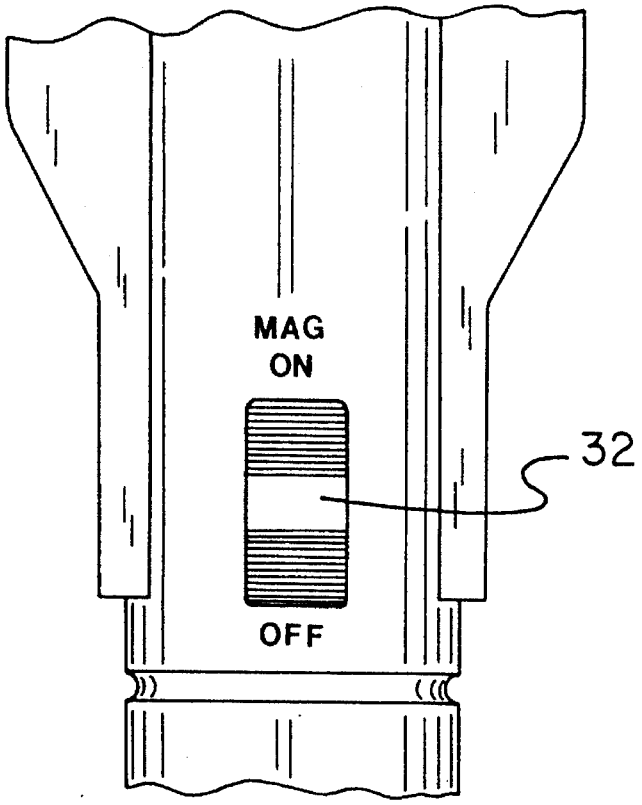
FIG. 5 is a partial view of the handle and particularly the on/off option for the electromagnet.
Figure 6:
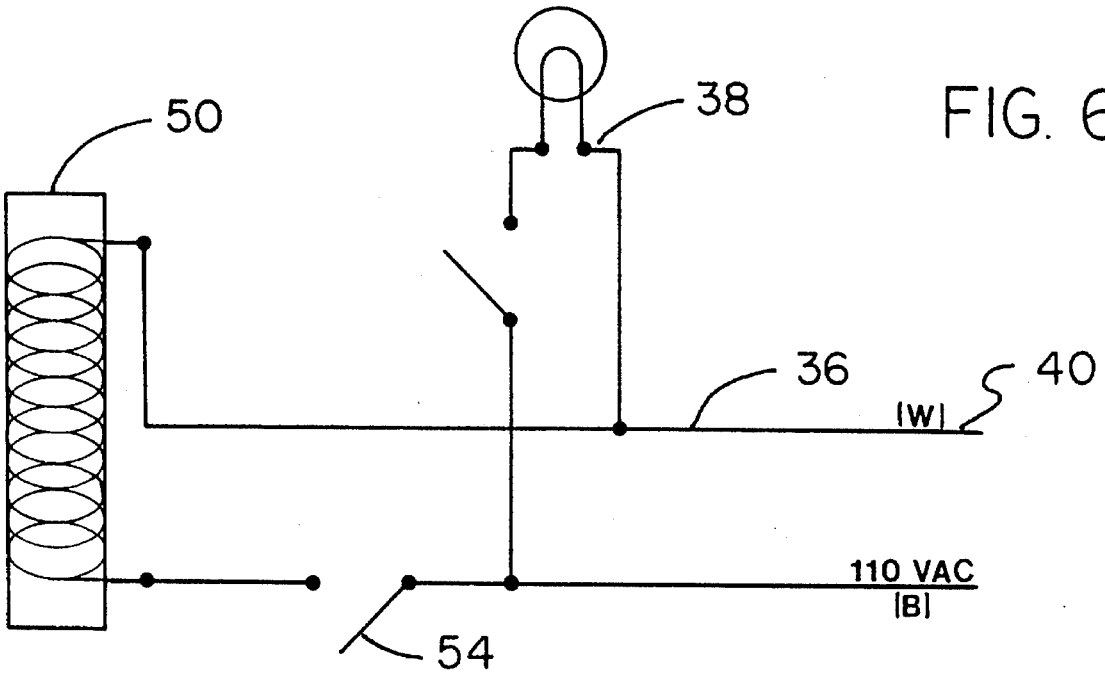
FIG. 6 is a schematic view of the light and the electromagnet.

With reference now to the drawings, and in particular, to FIG. 1 thereof, the preferred embodiment of the new and improved magnetic light embodying the principles and concepts of the present invention and generally designated by the reference number 10 will be described.

Specifically, it will be noted in the various Figures that the device relates to a new and improved magnetic light that magnetically mounts a drop light to a metallic surface on the hood of an automobile with an on/off option. In its broadest context, the device contains an oblong hollow handle, an electrical socket, a metal casing, and an electromagnet with the electrical socket and the electromagnet having an on/off option.

The device 10 contains an oblong hollow handle 12 having an first end 14, a second end 16, an intermediate extent 18 therebetween, an inner surface 20, an outer surface 22, an upper portion 24, and a lower portion 26. The upper portion 24 and lower portion 26 are coupled by a fastening means 28. The oblong hollow handle 12 is encompassed by an insulated plastic. A first switch 30 is integral with the outer surface 22. A second switch 32 is integral with the outer surface 22.

An electrical socket 34 is secured to the second end 16 of the oblong hollow handle 12. The electrical socket 34 functions to receive a light bulb. The electrical socket 34 has a wire 36 having a first end 38 and a second end 40. The first end 38 of the wire 36 is electrically secured to one end of the electrical socket 34. The second end 40 of the wire 36 has an electrical plug 42 thereattached. A push button switch 44 is attached to the electrical socket 34 thus allowing the light bulb to be in an on or off position. The push button switch 44 corresponds with the first switch 30 of the oblong hollow handle 12.

The device 10 contains a metal casing 46 that includes a plurality of planar surfaces. The metal casing 46 is secured to the second end 16 of the oblong hollow handle 12. The metal casing 46 has a generally flat surface. A metal cage 48 is hingedly secured to the metal casing 46. The metal cage 48 functions to prevent contact with a light bulb.

An electromagnet 50 is secured to the inner surface 20 of the intermediate extent 18 of the oblong hollow handle 12. The electromagnet 50 has a first wire 52 and a second wire 54. The first wire 52 is electrically connected with the metal casing 46. The second wire 52 is electrically connected with the second switch 32 of the oblong hollow handle 12 thus allowing the electromagnet 50 to be turned on to generate a magnetic field on the metal casing 46 or off to disengage the magnetic field.

The present invention is designed to be mounted on any adjacent and convenient metallic surface as one works. It is similar in construction to the commonly used "drop light," except a solid metal casing, or cage, surrounds the area at the rear of the bulb; the front of the bulb is covered by the conventional meshed cage to prevent contact with the hot bulb and provide for the necessary illumination.

A steel rod, wrapped with a copper coil, is housed within the handle of the present invention, and this, connected with the aforementioned metal casing, serves to generate the magnetic field. The present invention also features two opposed switches on the handle, one to energize the field as needed, and the other for the light itself. Hence, it can be seen that, with both the light and the magnet turned on, one can place the present invention in any of an infinite number of positions to best illuminate the project at hand.

The alternatives are not attractive. A drop light typically incorporates a hook at its end from which it must be hung if one cannot hold the light. This practice usually results in compromising the area to be illuminated since one cannot always find the ideally located projection from which to hang the light. The present invention addresses and eliminates these problems; it may be placed indiscriminately at any location and will firmly maintain this position until the magnet is turned off. The present invention will be a valuable acquisition indeed for anyone having the need to perform automotive repairs as well as the "do-it-yourselfer."

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved magnetic light that magnetically mounts a drop light to a metallic surface on the hood of an automobile with an on/off option comprising, in combination:

an oblong hollow handle having an first end, a second end, an intermediate extent therebetween, an inner surface, and outer surface, an upper portion, and a lower portion, the upper portion and lower portion coupled by a fastening means, the upper and lower portions being joined along a plane coincident with a longitudinal axis of the handle and the oblong hollow handle encompassed by an insulated plastic, a first switch coupled to the outer surface, a second switch coupled to the outer surface;

an electrical socket secured to the second end of the oblong hollow handle, the electrical socket functioning to receive a light bulb, a wire having a first end and a second end, the first end of the wire electrically secured to one end of the electrical socket, the second end of the wire having an electrical plug thereattached;

a metal casing including a plurality of planar surfaces, the metal casing secured to the second end of the oblong hollow handle, the metal casing having a generally flat surface, a metal cage hingedly secured to the metal casing, the metal cage functioning to prevent contact with a light bulb; and an electromagnet secured to the inner surface of the intermediate extent of the oblong hollow handle, the electromagnet having a first wire and a second wire, the first wire electrically connected with the metal casing, the second wire electrically connected with the second switch of the oblong hollow handle thus allowing the electromagnet to be turned on to generate a magnetic field on the metal casing or off to disengage the magnetic field.

2. An improved magnetic light comprising:

an oblong hollow handle having an first end, a second end, an intermediate extent therebetween, an inner surface, and an outer surface, the oblong hollow handle encompassed by an insulated plastic;

an electrical socket secured to the second end of the oblong hollow handle, the electrical socket functioning to receive a light bulb, a wire having a first end and a second end, the first end of the wire electrically secured to one end of the electrical socket, the second end of the wire having an electrical plug thereattached;

a metal casing including a plurality of planar surfaces, the metal casing secured to the second end of the oblong hollow handle, the metal casing having a generally flat surface, a metal cage hingedly secured to the metal casing, the metal cage functioning to prevent contact with a light bulb; and an electromagnet secured to the inner surface of the intermediate extent of the oblong hollow handle, the electromagnet having a wire, the wire electrically connected with the metal casing thus allowing the electromagnet to be turned on to generate a magnetic field on the metal casing.

3. The magnetic light as described in claim 2 and further comprising:

a first switch coupled to the outer surface of the oblong hollow handle, a push button switch attached to the electrical socket thus allowing the light bulb to be on or off, the push button switch corresponding with the first switch of the oblong hollow handle.

4. The magnetic light as described in claim 3 and further comprising a second switch coupled to the outer surface of the oblong hollow handle, the electromagnet having a second wire connected with the second switch, the second switch functioning to allow the electromagnet to be turned on to generate the electric field on the metal casing or off to disengage the magnetic field.

* * * * *